United States Patent [19]

Lin et al.

[11] Patent Number: 4,948,149

[45] Date of Patent: Aug. 14, 1990

[54] NET POSTS FOR BALL GAMES

[76] Inventors: Joe Lin, No. 158, Sec. 2, Chang-Pin Rd., Pei-Tun District, Taichung; Grace Liao, No. 8, Alley 4, Lane 324, Sec. 4, Cheng-Kung Rd., Nei-Hu District, Taipei, both of Taiwan

[21] Appl. No.: 370,795

[22] Filed: Jun. 23, 1989

[51] Int. Cl.[5] ..... A63B 61/02; F16B 7/14

[52] U.S. Cl. ..... 273/411; 273/29 BB; 403/104

[58] Field of Search ..... 273/411, 29 BB; 403/104

[56] References Cited

U.S. PATENT DOCUMENTS

| | | | |
|---|---|---|---|
| 2,841,425 | 7/1958 | Oeters | 403/104 |
| 3,724,885 | 4/1973 | Becker | 403/104 |
| 4,720,112 | 1/1988 | Stettner et al. | 273/411 |
| 4,732,395 | 3/1988 | Halverson | 273/411 |

*Primary Examiner*—William H. Grieb

*Attorney, Agent, or Firm*—Cushman, Darby & Cushman

[57] ABSTRACT

A net post for ball games comprising primarily a plurality of hollow tubes which are of different diameters and can be fitted one over the other is disclosed. An adaptor comprising an outer screwed sleeve member and a lining press member is provided for the connection of two hollow tubes. A slidable threading lug is fitted over each of the hollow tubes. By fitting the hollow tubes one over the other, the net posts of the present invention can be reduced in dimensions to facilitate storage, shipment and carrying and can also facilitate adjustment and operation. Moreover, the installation of the net posts and the height adjustment of the net for use are facilitated by the provision of the threading lugs.

2 Claims, 3 Drawing Sheets

PRIOR ART
Fig. 6.
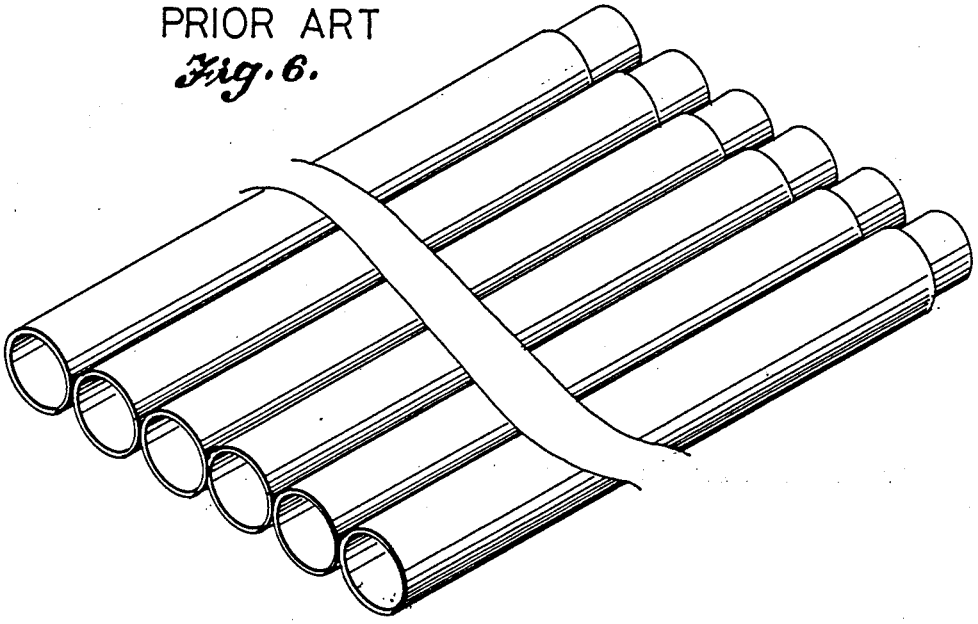
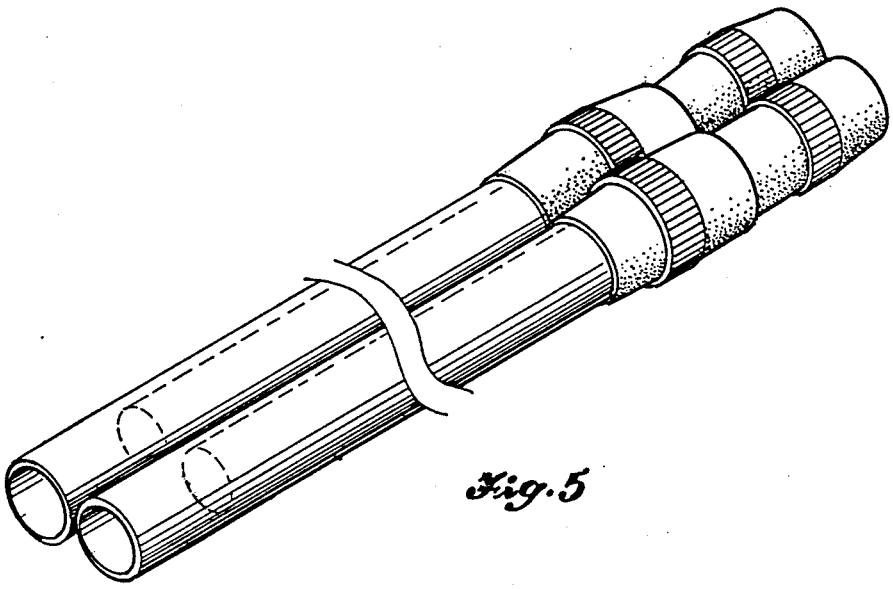
Fig. 5

NET POSTS FOR BALL GAMES

BACKGROUND OF THE INVENTION

The present invention relates to a type of net posts for ball games and, in particular, to improvements on a portable type of such net posts.

In the affluent society of today, greater emphasis has been placed on leisure life than ever before. Activities such as camping, picnic, excursion are favored by many. On such occasions, people will enjoy the life in the country. To make the outdoor activities more interesting, ball games or exercises such as badminton, volleyball, tennis, and the like which can be played by most of the people are popular. In order that such ball games can be played outdoors at places other than the dedicated playgrounds, a combination, portable net posts for ball games is now available on the market.

In general, conventional portable net posts for ball games are each comprised of three hollow metal tubes which are connected in series to become an individual post wherein each post is of a configuration which can be separated and assembled such that the posts can be carried along. Individual hollow metal tubes are connected by fitting one end of the tube of smaller diameter into one end of another tube of larger diameter. Thus, so far as the portability of the nest posts is concerned, conventional posts can be reduced only in length for carrying purpose without substantial reduction in dimensions. Also, such net posts, when used for different ball games (such as badminton, tennis, or volleyball), are rather inconvenient to operate due to the fact that different heights required for the net for different ball games and that the net is fastened directly to the posts by strings.

In addition, with the current trend in international trade, for products to be competitive in the world market, shipment and handling has become a major concern for the manufacturers. That is to say, costs of the products can be reduced in the market if it is possible to effectively reduce the dimensions of the products such that the shipping expenses are substantially reduced.

SUMMARY OF THE INVENTION

Accordingly, the primary object of the present invention resides in that a plurality of hollow tubes which are of varied diameters and which can be telescopically fitted one over the other are assembled to become a net post. An adaptor comprising an outer screwing sleeve member and a lining press member is provided so that two hollow tubes are connected such that the two hollow tubes can be connected in place by engagement of the threads. By having individual tubes which can be fitted one over the other to form respective posts, it is possible to reduce the dimensions thereby to facilitate carrying and shipment. Moreover, by the provision of the adaptors, respective hollow tubes can be telescopically adjusted with respect to their position thereby to facilitate assembling operation and height adjustment of the net.

Another object of the present invention resides in that a threading lug having a threading hole is fitted over the outer wall of respective hollow tubes, the threading lugs serving to provide fine height adjustments of the net for use and to facilitate the threading operation when the posts are installed.

BRIEF DESCRIPTION OF THE DRAWINGS

FIG. 5 is a schematic exploded perspective view showing the conventional portable net posts for ball games.

FIG. 6 is a schematic perspective view showing the present invention in a contracted condition ready for carrying along.

DETAILED DESCRIPTION OF THE INVENTION

Figure 1:
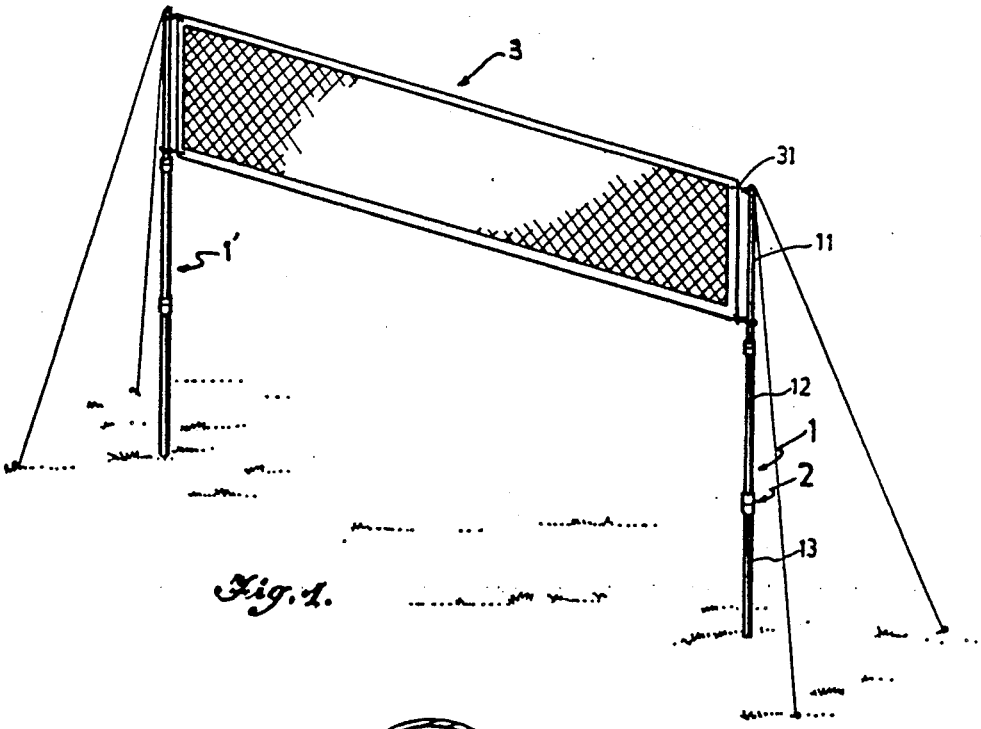
FIG. 1 is a view showing an embodiment of the present invention assembled in a ready-for-use condition.

As shown in FIG. 1, the present invention relates to an improved type of portable net posts for ball games which can be used outdoors. The net posts (1) are each composed primarily of a plurality of hollow tubes (11, 12, 13) which are of different diameters for fitting one over the other in a contractible configuration and which are connected by an adaptor (2) such that a net can be stretched between two such posts (1, 1').

Figure 3:
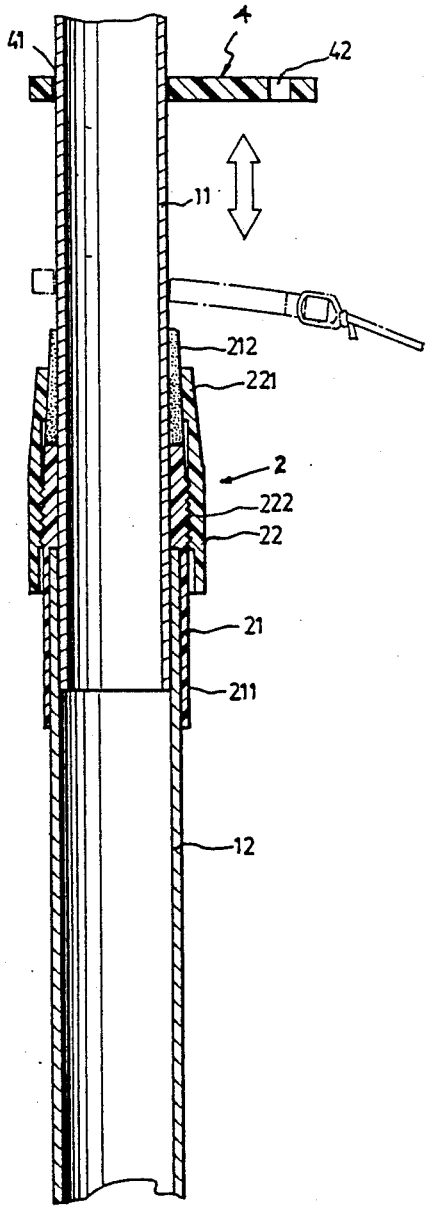
FIG. 3 is a schematic view, in cross section, showing part of the structure of the present invention in an assembled condition.

As shown in FIG. 3, there is shown two connected hollow tubes (11, 12) in which one hollow tube (11) can be snugly inserted into another hollow tube (12) such that the two tubes are connected into a telescopic configuration.

Figure 2:
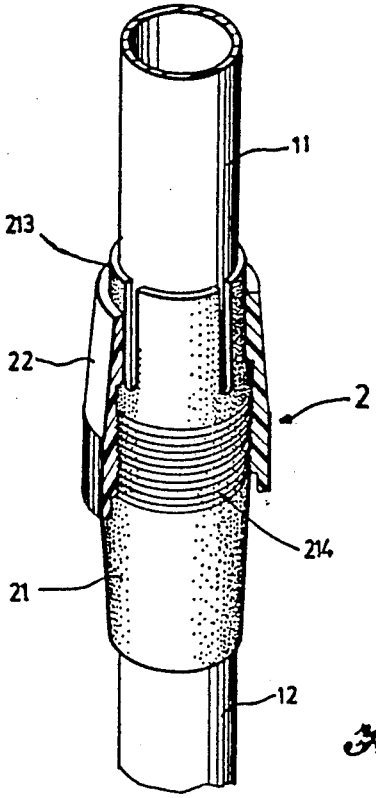
FIG. 2 is a perspective view, partly in cross section, showing an embodiment of the adaptor used in the present invention.

As shown in FIGS. 2 and 3, an adaptor (2) is provided at the place where the two hollow tubes (11, 12) are connected, the adaptor (2) comprising an outer screwed sleeve member (22) and a lining press member (21), wherein the outer screwed sleeve member (22) is a threaded cylindrical through sleeve with one end being shaped into a tapered opening (221) and the inner wall of the other end being formed with threads (222); the lining press member (21) is in hollow cylindrical shape with one end (211) being of an inner diameter for exact threaded fitting over one end of the hollow tube (12) and allowing another hollow tube (11) to extend into the other end (212) thereof so as to be loosely fitted, the other end (212) comprising a plurality of spaced apart press plates (213); in addition, the outer wall in the intermediate section of the lining press member being formed with threads (214) which engage the threads (222) on the outer sleeve member (22).

The outer wall of the hollow tube (11) is provided with a threading lug (4) made of a suitably flexible plastic material with one end thereof being formed with a round hole (41) to allow the hollow tube (11) to be inserted therethrough and the other end thereof being formed with a threading hole (42) in the shape of a small hole.

As shown in FIGS. 3 and 5, the hollow tube (11) is telescopically slidable in another hollow tube (12) such that when the outer screwed sleeve member (22) is tightened, the tapered opening (221) of the outer sleeve member (22) will squeeze the press plates (213) against the outer wall of the hollow tube (11). As a result, the hollow tube (11) is squeezed by the external force to become securely engaged with the press plates (213)

thereby establishing a fixed relation in position between the hollow tubes (11 and 12). Conversely, when the outer screwed sleeve member (22) is loosened, the tapered opening (221) of the outer sleeve member (22) moves gradually away from the wedge shaped press plates (213) and thus the hollow tube (11) stays released from the press plates (213) such that the hollow tube (11) can be telescopically slidable within another hollow tube (12).

Therefore, in the carry-along configuration, the hollow tube (11) can be slid into another hollow tube (12) to become the configuration as shown in FIG. 5 such that they are not only convenient to carry along but also more convenient for shipment at lower shipping expenses due to the substantially reduced dimensions, thereby indirectly contributing to cost reduction to make the products more competitive in the market. In operation, it needs only to draw each of the hollow tubes, such as (11), out from another hollow tube, such as 12) to the desired length and then tighten the outer screwed sleeve member (22), urging the press plates (213) to press against the outer wall of the hollow tube (11) such that individual hollow tubes can be securely connected by means of the adaptors (2), so as to take the form of the net posts (1) as shown in FIG. 1.

Then, a connecting string (31) for the net (3) as shown in FIG. 1 is inserted to be fastened in the threading hole (42) on the threading lug (4) such that the net (3) is stretched between two posts (1, 1'). To adjust the height of the net (3) for different purposes (such as for badminton or tennis), the adaptors (2) are simply loosened to adjust the height to which the posts (1) are extended, thus to effect the height adjustment of the net (3).

As shown in FIGS. 1 and 3, when there is a difference in the height of the net between the two posts, fine adjustments of the effective height of the net can be achieved by pushing the threading lug (4) to move in the hollow tube (11) as shown in FIG. 3.

Figure 4:
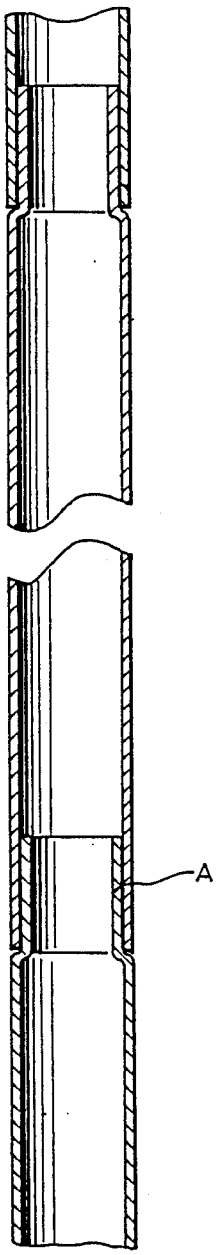
Fig. 4 PRIOR ART
FIG. 4 is a schematic view, in cross section, showing a conventional type of portable net posts for ball games in an assembled condition.

While the present invention provides a type of portable net posts which, as compared to the conventional posts, are more complicated in structure, it saves the machining costs because that in the present invention it is not necessary to have the ends of individual metal hollow tubes formed into narrow ends (A) as in the case of conventional posts shown in FIG. 4. In addition, metal tubes of smaller diameters, such as hollow tubes (11, 12) can be used. This results in a saving of costs in material. Furthermore, as described earlier, the present invention, when contracted, has reduced dimensions as compared to the conventional posts (about $\frac{2}{3}$ as those of the conventional ones), resulting in much lowered shipping expenses The overall costs can thus be substantially reduced such that the present invention is not only practical but also has utilization value in industrial production.

We claim:

1. A portable net post for ball games comprising:

a plurality of hollow tubes which are of different diameters for fitting one into the other;

an adaptor comprising an outer screwed sleeve member and an lining press member, wherein the lining press member is of hollow cylindrical shape, one end thereof being securely fitted over one end of one hollow tube and the other end being formed with a plurality of spaced apart press plates, the outer wall of the intermediate section thereof being formed with threads; the outer screwed sleeve member is of cylindrical shape with the inner wall of one end thereof formed with threads which engage the threads on the lining press member and the other end being shaped into a tapered opening, such that the hollow tubes of different diameters can be fitted one over the other and the adjacent hollow tubes can be securely connected by means of the adaptors.

2. The net post as set forth in claim 1 further comprising a plurality of threading lugs, one end of the lug being formed with a large round hole which mates the outer diameter of the hollow tube and which can be snugly fitted over said hollow tube for sliding movement thereon the other end thereof being formed with a threading hole.

* * * * *